United States Patent [19]

Nagel et al.

[11] 3,938,738

[45] Feb. 17, 1976

[54] PROCESS FOR DRAWING IN AND COMPRESSING GASES AND MIXING THE SAME WITH LIQUID MATERIAL

[75] Inventors: Otto Nagel; Heribert Kuerten, both of Neustadt; Peter Zehner, Ludwigshafen, all of Germany

[73] Assignee: BASF Aktiengesellschaft, Ludwigshafen (Rhine), Germany

[22] Filed: Mar. 5, 1975

[21] Appl. No.: 555,633

[30] Foreign Application Priority Data

Mar. 6, 1974 Germany ..... 2410570

[52] U.S. Cl. ..... 239/9; 239/400; 239/428.5

[51] Int. Cl.[2]..... A62C 1/12; B05B 7/10; E03C 1/08

[58] Field of Search ..... 239/400, 428.5, 8, 9

[56] References Cited

UNITED STATES PATENTS

| | | | |
|---|---|---|---|
| 391,865 | 10/1888 | Schutte | 239/400 |
| 426,040 | 4/1890 | Moore | 239/400 |
| 2,176,682 | 10/1939 | Pedrick | 239/9 |
| 3,625,436 | 12/1971 | Wirths | 239/428.5 |
| 3,662,960 | 5/1972 | Mitchell et al. | 239/400 |
| 3,684,186 | 8/1972 | Helmrich | 239/400 |
| 3,727,839 | 4/1973 | Marsh | 239/8 |
| 3,853,271 | 12/1974 | Freshour et al. | 239/8 |
| 3,866,413 | 2/1975 | Sturgess | 239/400 |

*Primary Examiner*—Lloyd L. King
*Attorney, Agent, or Firm*—Johnston, Keil, Thompson & Shurtleff

[57] ABSTRACT

A process for drawing in and compressing gases and mixing the same with liquid material, wherein the gases are first premixed with one or more liquid jets at a velocity of from 10 to 70 m/sec, the smallest cross-sectional area of the mixing nozzle being at a distance from the propulsive jet which is equal to from 1 to 10 times the smallest hydraulic diameter of the mixing nozzle, which smallest cross-sectional area of the mixing nozzle is equal to from 1.5 to 15 times the smallest cross-sectional area of the propulsive jet. The two-phase liquid mixture is passed through the mixing nozzle to the narrowest point of an impulse exchange tube disposed in the liquid medium, which impulse exchange tube is open at its inlet and outlet and is preferably provided with a diffuser. The smallest cross-sectional area of the impulse exchange tube is equal to from 1.2 to 20 times the smallest cross-sectional area of the mixing nozzle and the length of the impulse exchange tube is up to 20 times its smallest hydraulic diameter.

3 Claims, 3 Drawing Figures

Figure 1:
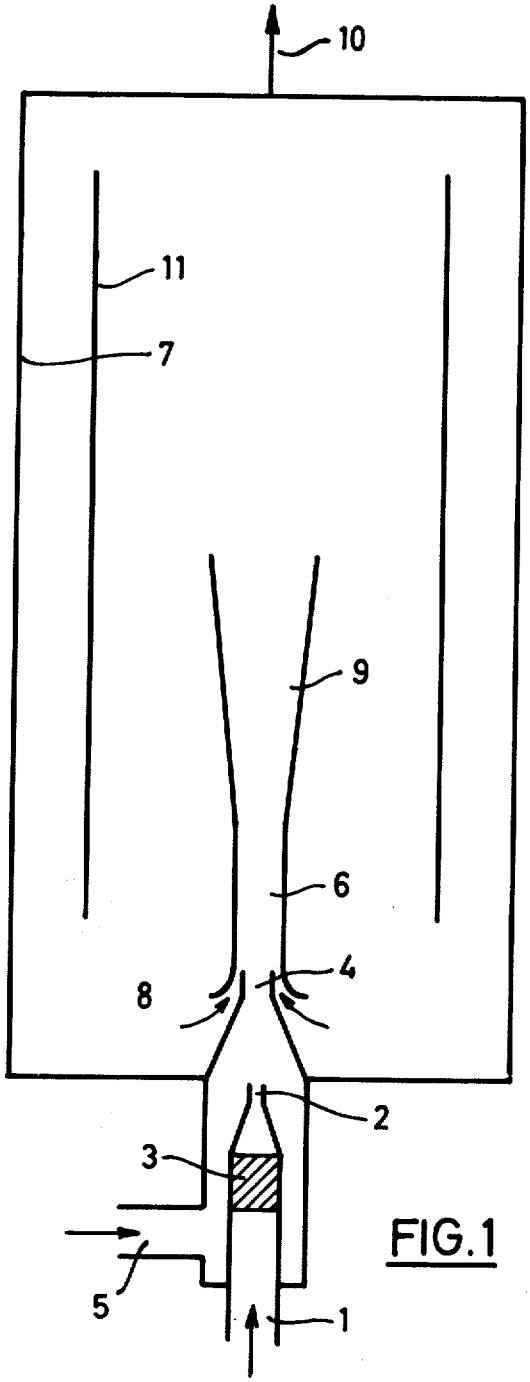

3
2
1
0
$\dot{V}_L / \dot{V}_W$
B
A 0
0,1
0,2
0,3
$\Delta P_L / \Delta P_t$

PROCESS FOR DRAWING IN AND COMPRESSING GASES AND MIXING THE SAME WITH LIQUID MATERIAL

This invention relates to a process for drawing in and compressing gases and mixing the same with liquid material, i.e. for oxidation in liquid phase with air.

When reactions are carried out between liquids and gases, the two reactants must be mixed together as thoroughly as possibly, since the rate of the reaction is usually directly determined by the rate of gas absorption by the liquid. For this reason, a number of processes have been developed for mixing gases and liquids, and the choice of process mainly depends on the operating conditions such as pressure and temperature and on the type of chemical reaction involved. One of the most recent developments in this field is the multi-stream ejector disclosed in a number of publications (Chem.-Ing.-Techn., 42nd Year, 1970, No. 7, pp. 474 to 479; loc. cit., No. 14, pp. 921 to 926). In this apparatus, the gas is dispersed in the field of shear forces between a very fast jet of liquid and liquid flowing slowly through an impulse exchange chamber, by which means a large interfacial area is produced. In addition to the liquid pump for producing the propulsive jet, compressors are required for compressing the gases to the reactor pressure. particularly in high pressure reactors, in which a portion of the gas escapes unconsumed at the top of the reactor and must be recompressed and re-fed to the reactor, the use of such recycle gas compressors operating at high pressures involves high expense. For this reason, ejectors are frequently used for compressing and conveying the gases. In such devices, also known as jet pumps, gas is drawn in by a fast jet of liquid and is mixed with the liquid in a usually cylindrical tube. Compression of the gas takes place both in the cylindrical mixing tube and in the diffuser connected thereto. At low pressures, the energy efficiency obtained is of the order of 20%. For a given energy consumption, the interfacial area produced with ejectors is much smaller than that produced in an ejector/impulse exchange tube arrangement, since in the former the gas only contacts the liquid jet, whereas in the latter reactor liquid is drawn into the impulse exchange chamber in an amount which is many times greater than the amount of liquid in the liquid jet. Moreover, a large portion of the energy of the liquid jet of an ejector is converted to heat by friction against the wall of the mixing tube without having contributed to the mixing operation, whilst in a multi-stream ejector virtually all of the energy is dissipated in the impulse exchange chamber and thus utilized for gas distribution. Although the multi-stream ejector is superior as regards the optimum production of interfacial area, it still suffers from the above drawback of itself not being able to draw in and convey gas.

For this reason, an apparatus referred to below as a "multi-stream jet pump" has been developed by means of which gas can be drawn in and conveyed as with an ejector, whilst a high interfacial area can be produced as in multi-stream ejectors. Under identical operating conditions, energy efficiencies for gas compression are obtained which, at 30%, are about 50% higher than in the case of ejectors alone.

The invention relates to a process for drawing in gases and mixing the same with liquid in one such apparatus, wherein a. the gases are premixed in a mixing nozzle with one or more liquid jets traveling at a velocity of from 10 to 70 m/sec, b. the smallest cross-sectional area of the mixing nozzle is situated from the propulsive nozzle at a distance which is equal to from 1 to 10 times the smallest hydraulic diameter of the mixing nozzle and c. the said smallest cross-sectional area of the mixing nozzle is equal to from 1.5 to 15 times the smallest cross-sectional area of the propulsive nozzle, d. the two-phase liquid/gas mixture emerging from this mixing nozzle is passed to the most constricted portion of an impulse exchange tube which is present in the liquid medium, is open at its inlet and outlet ends and is preferably provided with a diffuser, and e. the smallest cross-sectional area of the impulse exchange tube is equal to from 1.2 to 20 times the smallest cross-sectional area of the mixing nozzle and the length of the impulse exchange tube is equal to from 0 to 20 times its smallest hydraulic diameter.

Advantageously, the gas is premixed in a short mixing nozzle with the propulsive jet traveling at a velocity of from 20 to 50 m/sec. Such mixing may be effected by a jet showing a twist as produced by means of a twist guide or a tangential liquid feed, or by the subdivision of the propulsive liquid into a number of individual jets. The best conditions prevail when the smallest cross-section of the mixing nozzle is from 1.5 to 15 times and preferably from 3 to 10 times greater than the smallest cross-sectional area of the propulsive nozzle or nozzles. The gas, thus premixed with liquid, is then passed to an impulse exchange chamber which is open at both ends and is disposed in the liquid medium. The impulse exchange with the very fast liquid/gas mixture causes a second and slower stream of liquid to be drawn in and mixed with said mixture. We have found that the best mechanical efficiencies in gas compression are achieved when the mixing tube passes the gas/liquid mixture to the most constricted part of the impulse exchange tube, since at this point the liquid drawn in attains maximum velocity prior to impulse exchange and thus, according to hydrodynamic laws, provides minimum static pressure. This static pressure, which is lower than the reactor pressure, is built up by impulse exchange in the preferably cylindrical impulse exchange tube and also by conversion of kinetic energy to static energy in a diffuser located downstream of the impulse exchange tube. The most constricted cross-sectional area of the impulse exchange tube should be from 1.2 to 20 times and preferably from 1.5 to 4 times the smallest cross-sectional area of the mixing nozzle and the length of the impulse exchange tube should be from 0 to 20 times and preferably from 2 to 10 times its smallest hydraulic diameter. By hydraulic diameter we mean the diameter of a cylindrical tube which, for a given throughput and given length, gives the same pressure loss as the said impulse exchange tube.

The process of the invention for compressing gases by means of one or, if desired, a plurality of very fast liquid jets substantially differs from the principle of operation of normal ejectors. In the latter, only the propulsive liquid is mixed with the sucked-in gas in a usually cylindrical mixing tube, the gas being entrained by the liquid. Compression of the gas is effected solely by the deceleration of the liquid both in the mixing tube and in the diffuser usually located downstram thereof. In our novel process, however, the passage of liquid and gas together to the narrowest portion of the open-ended impulse exchange tube causes a second stream of liquid to be drawn in and strongly accelerated, as a result of which there is a pressure drop at this point almost down to the level of the suction pressure of the gas. Downstream of the mixture tube, in which the gas pressure is raised only slightly, there is a sudden interchange of the disperse phases due to the stream of liquid drawn in, with the result that the gas is entrained in the form of fine bubbles virtually without slip. Subsequent compression by the conversion of kinetic energy into compression energy in the diffuser is more efficiently effected than in ejectors on account of the greater amount of liquid involved. A further advantage is that the flow losses caused by wall friction are smaller in the impulse exchange tube for a given throughput on account of the slower flow velocity therein due the fact that the diameter of the impulse exchange tube is greater than that of the mixing tube of normal ejectors. Thus in the process of the invention it is possible to achieve energy efficiencies in gas compression which are up to 70% higher than in ejectors. Moreover, the energy of dissipation produces much greater interfacial areas between gas and liquid in the same way as multi-stream ejectors.

Thus the invention combines the advantages of multi-stream ejectors (high specific interfacial area) with the advantages of normal ejectors (gas compression) whilst avoiding the drawbacks of the individual systems, e.g. no gas-sucking action in multi-stream ejectors and poor utilization of the energy of dissipation in the production of interfacial areas in ejectors.

Figure 2:
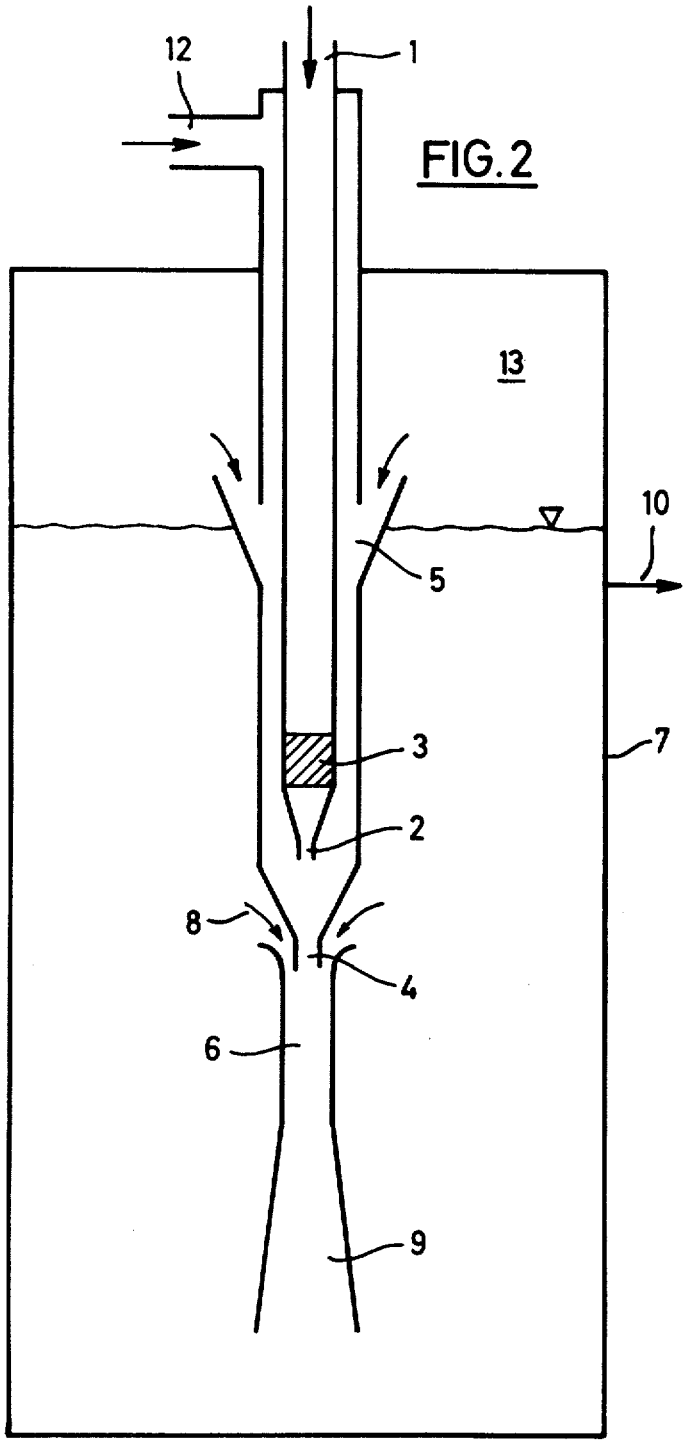
Figure 3:
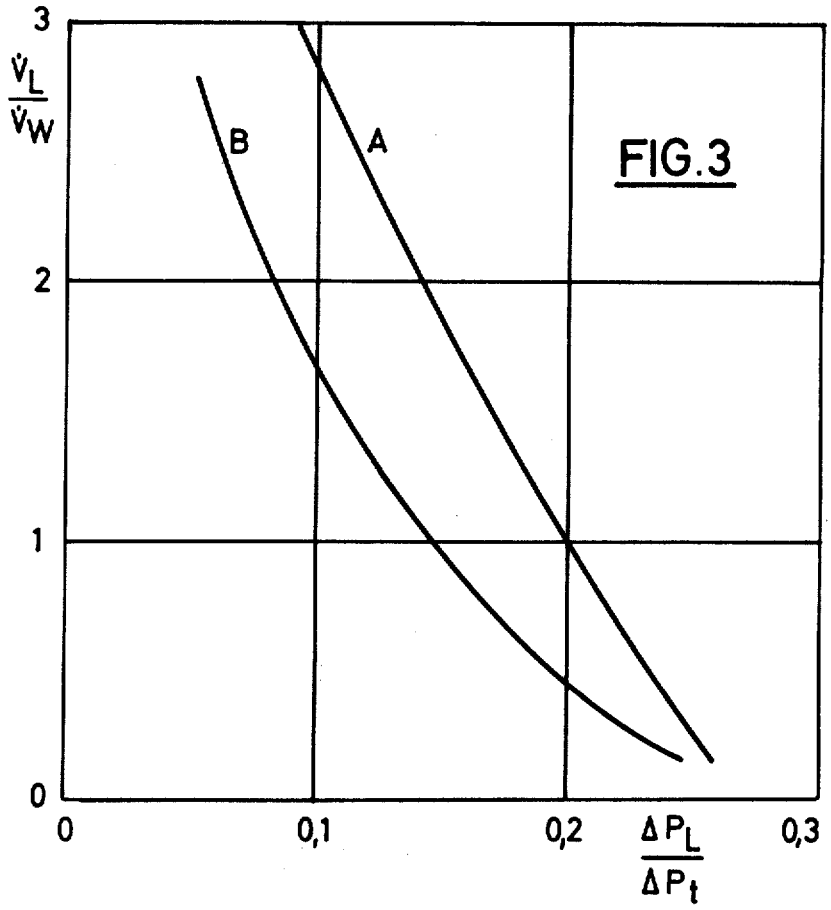

FIGS. 1 and 2 of the accompanying drawings illustrate the mode of operation of the invention; and FIG. 3 is a graphical illustration of the comparative suction tests given in Example 2 below.

The liquid is fed at point 1 and caused to rotate at a point just upstream of the propulsive jet 2 by means of the twist guide 3 and is mixed in the mixing nozzle 4 with the gas sucked in through inlet 5. This liquid/gas mixture is fed to the most constricted part of the impulse exchange tube 6, as a result of which a second stream of liquid 8 is drawn in from the liquid tank 7. In the diffuser 9, the liquid/gas mixture is compressed to the reactor pressure. The resulting mixture leaves the tank through line 10.

FIG. 1 shows a multi-stream jet pump installed vertically in a reactor. As in the case of multi-stream ejectors, it is possible, when using the said pump, to produce controlled liquid circulation on the principle of the air-lift by using an insert tube 11.

In FIG. 2, the multi-stream jet pump is used as a recycle gas pump. Fresh gas is fed to the reactor 7 through line 12 and is sucked in and dispersed by the pump operating in the downward direction. The unconsumed gas passing into the gas chamber 13 is resucked into the liquid together with fresh gas, such re-entry of the unconsumed gas being effected through the suction inlet 5.

EXAMPLE 1

In a reactor of the kind shown in FIG. 1 (without insert tube 11) and having a diameter of 300 mm and a height of 2 m, sodium sulfite was oxidized with air in aqueous solution in the presence of cobalt as catalyst.

The air feed was effected by means of a multi-stream jet pump having the following dimensions:

| | |
|---|---|
| Diameter of jet nozzle 2 | 6 mm |
| diameter of twist guide 3 | 26 mm |
| external angle of twist of the twist guide | 30° |
| diameter of mixing nozzle 4 | 14.7 mm |
| length of mixing nozzle over cylindrical portion | 10 mm |
| distance between the outlet of the mixing nozzle and that of the propulsive nozzle | 40 mm |
| diameter of impulse exchange tube | 20.8 mm |
| length of impulse exchange tube | 104 mm |
| angle of taper of diffuser | 5° |
| diameter of diffuser at outlet end | 41.6 mm |

To produce a propulsive jet having a velocity of 20 m/sec, the solution was withdrawn from the top of the reactor at a rate of 2 $m^3/h$ and fed to nozzle 2. At an absolute suction pressure of the gas of 0.95 bar, air was conveyed to the reactor at a rate of 4.8 $m^3/h$ (S.T.P.). The catalyst concentration was $2.7 \times 10^{-4}$ kmole/$m^3$ of cobalt and the temperature of the solution was 20°C. 77% of the atmospheric oxygen provided was converted.

If, however, a conventional ejector as described below is installed in the same reactor as that used in Example 1 and operated under the same conditions, the oxygen conversion obtained is lower even at higher pumping rates:

| | |
|---|---|
| Jet nozzle as in Example 1 | |
| diameter of mixing tube | 14.7 mm |
| length of mixing tube | 74 mm |
| angle of taper of diffuser | 5° |
| diameter at outlet end of the diffuser | 29.4 mm |

In order to draw in the same amount of air, i.e. 4.8 $m^3/h$ (S.T.P.), it is necessary to pump 2.4 $m^3/h$ of solution through the nozzle. This means that the pumping rate must be increased by 70%. Despite this higher energy output, the oxygen in the sucked-in air is converted only to an extent of 73%, i.e. the total conversion is 5% less than that obtained in the jet pump of the invention.

EXAMPLE 2

Using the multi-stream jet pump described in Example 1 and the conventional ejector described in Example 1 comparative suction tests were carried out in a tank filled with water, the diameter of the tank being 300 mm and its height 2.2 m. In FIG. 3, the ratio of the drawn-in volume of air $V_L$ to the volume of propulsive jet $V_W$ is plotted against the pressure increase of the gas $\Delta p_L$ divided by the pressure loss of the propulsive nozzle $\Delta p_t$ and thus rendered dimensionless. It is clearly seen that over the entire range tested, in which the maximum efficiencies of both devices occur, the jet pump (A) is superior to the ejector (B). For given operating conditions, the volume of entrained gas may be up to 70% more in the case of the invention. The maximum energy efficiencies are 30% for the multi-stream pump and only 17% for the ejector.

EXAMPLE 3

When 2 $m^3/h$ of water are pumped through the propulsive nozzle 2 of the jet pump described in Example 1, 4.8 $m^3/h$ of air (S.T.P.) at a suction pressure of 0.95 bar are compressed by 0.25 bar and conveyed to the reactor 7. The volume of air conveyed by the same jet pump under the same operating conditions is diminished to 2.1 $m^3/h$ (S.T.P.) when the distance between the outlet of the mixing nozzle 4 and the smallest cross-section at the inlet of the impulse exchange tube 6 is 10 mm. This is equivalent to an output drop of 54%.

EXAMPLE 4

If the jet pump described in Example 1 is used without the twist guide 3, only 0.85 $m^3/h$ of air (S.T.P.) are entrained under the same conditions as described in Example 3, i.e. the volume of air is 82% less than when the twist guide is used.

EXAMPLE 5

Using the ejector jet mixer of Example 1, but without diffuser 9, under the operating conditions of Example 3, 1.8 $m^3/h$ of air (S.T.P.) are pumped into the reactor. The output drop is 42%.

EXAMPLE 6

The jet pump may also be operated, at an output drop of 17%, without the use of the impulse exchange tube 6 but with the diffuser 9 and tangential feed. The volume of air pumped into the reactor is 4 $m^3/h$ (S.T.P.), which is still 38% higher than that extrained by the conventional ejector of Example 2 which, when operated under the conditions described in Example 3, pumps only 2.9 $m^3/h$ of air (S.T.P) into the reactor.

We claim:

1. A process for drawing in and compressing gases and mixing the same with liquid, comprising the steps in which a. the gases are premixed in a mixing nozzle with one or more liquid jets traveling at a velocity of from 10 to 70 m/sec, b. the smallest cross-sectional area of the mixing nozzle is situated from the propulsive nozzle at a distance which is equal to from 1 to 10 times the smallest hydraulic diameter of the mixing nozzle and c. the said smallest cross-sectional area of the mixing nozzle is equal to from 1.5 to 15 times the smallest cross-sectional area of the propulsive nozzle, d. the two-phase liquid/gas mixture emerging from this mixing nozzle is passed to the most constricted portion of an impulse exchange tube which is present in the liquid medium, is open at its inlet and outlet ends and is preferably provided with a diffuser, and e. the smallest cross-sectional area of the impulse exchange tube is equal to from 1.2 to 20 times the smallest cross-sectional area of the mixing nozle and the length of the impulse exchange tube is equal to from 0 to 20 times the smallest hydraulic diameter.

2. A process as claimed in claim 1, wherein a substantial percentage of the gas compression is effected by impulse exchange between the liquid jet mixed with sucked-in air and the circulated slower stream of liquid in the impulse exchange tube, the velocity energy formed being converted in the diffuser.

3. A process as claimed in claim 1, wherein mixing of the sucked-in gases with the propulsive liquid in the mixing nozzle is assisted by the presence of a twist in the liquid, this being produced either by an appropriate twist guide or by tangential feed of the liquid, upstream of the propulsive jet.

* * * * *